US006301945B1

(12) United States Patent
Roseliep

(10) Patent No.: US 6,301,945 B1
(45) Date of Patent: Oct. 16, 2001

(54) RACK SLIDE ASSEMBLY AND MACHINE FOR ROLLING SPLINES IN A ROUND WORKPIECE

(75) Inventor: Robert E. Roseliep, Grosse Pointe, MI (US)

(73) Assignee: Utica Enterprises, Inc., Shelby Township, MI (US)

( * ) Notice: Subject to any disclaimer, the term of this patent is extended or adjusted under 35 U.S.C. 154(b) by 0 days.

(21) Appl. No.: 09/585,691

(22) Filed: Jun. 1, 2000

(51) Int. Cl.[7] ..... B21H 5/00
(52) U.S. Cl. ..... 72/88
(58) Field of Search ..... 72/88, 90

(56) References Cited

U.S. PATENT DOCUMENTS

| | | | | |
|---|---|---|---|---|
| 411,480 | * | 9/1889 | Warren | 72/88 |
| 2,967,444 | * | 1/1961 | Hallberg | 72/88 |
| 3,726,118 | * | 4/1973 | Van De Meerendonk | 72/90 |
| 4,615,197 | * | 10/1986 | Alleback | 72/88 |
| 4,677,837 | * | 7/1987 | Jackson | 72/88 |
| 5,345,800 | * | 9/1994 | Smith | 72/90 |
| 5,970,768 | | 10/1999 | Killop et al. . | |
| 5,983,690 | | 11/1999 | Killop et al. . | |
| 5,987,953 | | 11/1999 | Killop et al. . | |

FOREIGN PATENT DOCUMENTS

| | | | | |
|---|---|---|---|---|
| 2242637 | * | 10/1991 | (GB) | 72/88 |

* cited by examiner

*Primary Examiner*—Daniel C. Crane
(74) *Attorney, Agent, or Firm*—Brooks & Kushman P.C.

(57) ABSTRACT

A machine (10) incorporates slide assemblies (12) for adjusting the spacing between toothed forming racks (14) supported by the slide assemblies to roll form splines in a workpiece (16). Each slide assembly (12) includes a main slide (78) supported for movement on an associated base portion (30) and also includes a secondary slide (80) adjustable mounted on the main slide (78) under the control of an adjuster (76). A leading end (82) of each slide assembly (12) includes a pivotal connection (84) and a trailing end (86) thereof supports the adjuster (76) that operates in association with a fixed thrust plate (92), a movable thrust plate (94) moved by an actuator (98), and a thrust connector (96) that extends between the fixed and movable thrust plates and upon operation of the actuator pivots the secondary slide (80) about the main slide (78) in order to provide the rack spacing adjustment.

14 Claims, 6 Drawing Sheets

Fig. 3
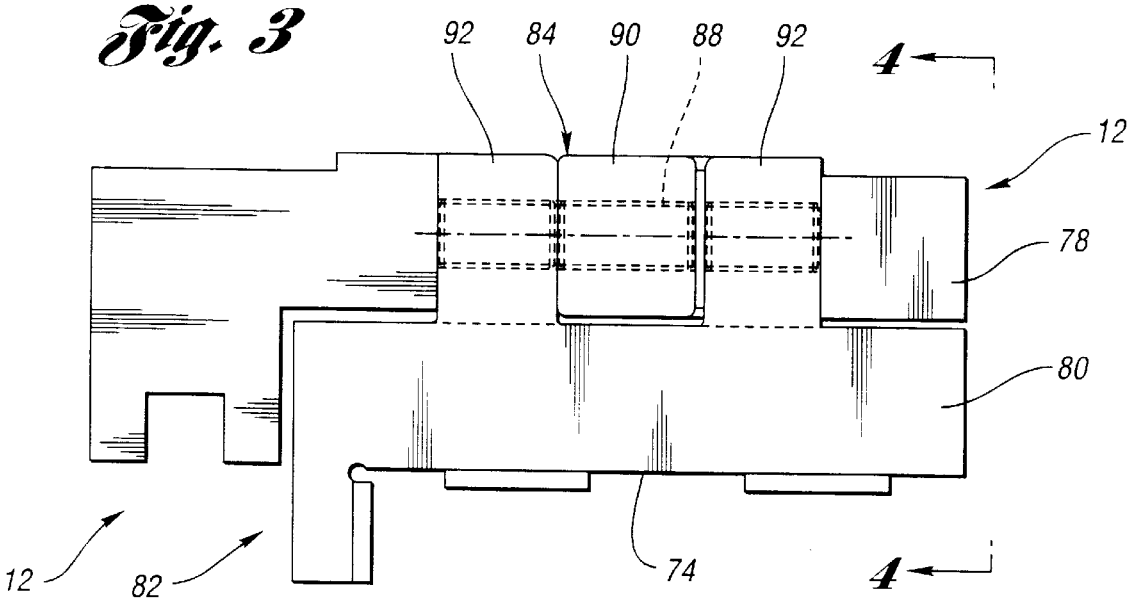
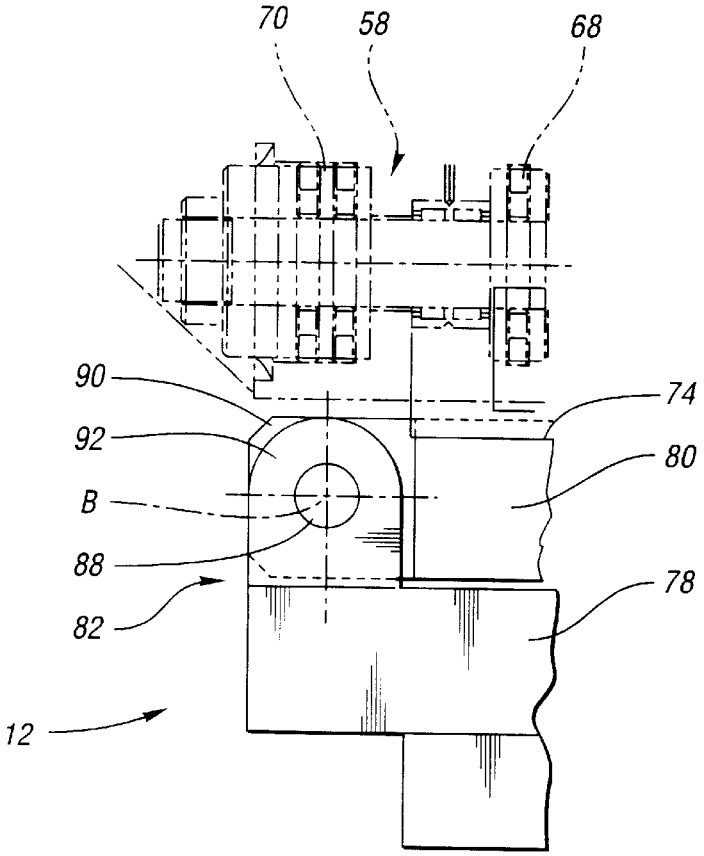
Fig. 4

RACK SLIDE ASSEMBLY AND MACHINE FOR ROLLING SPLINES IN A ROUND WORKPIECE

TECHNICAL FIELD

This invention relates to a slide assembly for supporting an elongated toothed forming rack for movement that roll forms splines in a round workpiece, and the invention also relates to a machine including a pair of the rack slide assemblies.

BACKGROUND ART

The U.S. Pat. Nos. 5,970,768, 5,983,690 and 5,987,953 of James Thomas Killop and Robert E. Roseliep disclose a machine for roll forming power transmission formations, i.e., splines, in a round workpiece. With such machines, a pair of slide assemblies conventionally mount a pair of toothed forming racks of elongated shapes for movement in opposite directions as each other from an end-to-end relationship to an overlapping relationship to engage a round workpiece therebetween and provide roll forming of the splines. With such spline rolling, the spacing of the forming racks is critical to provide accurate formation of the shape of the splines. This has conventionally been done by the use of tapered wedges that require a setup operation of the associated machine. Since the size of the workpiece can vary from one heat treat batch to the next, it is also necessary at times to provide a different setup operation during a single run of the same part upon movement from one batch to the next.

DISCLOSURE OF INVENTION

One object of the present invention is to provide an improved slide assembly for supporting an elongated toothed forming rack for movement that roll forms splines in a round workpiece rotatably mounted about a central axis.

In carrying out the above object, the slide assembly of the invention includes a rack support surface for supporting the rack in a spaced relationship with respect to the central axis. An adjuster of the slide assembly adjusts the spacing between the support surface of the slide assembly and the central axis to control the extent of roll forming splines in the workpiece.

The slide assembly includes a main slide that is supported for movement with respect to the central axis about which the workpiece rotates. The slide assembly also includes a secondary slide mounted by the main slide and defining the rack support surface that supports the rack. The adjuster of the slide assembly extends between the main slide and the secondary slide to adjust the positioning therebetween in order to adjust the spacing between the rack supported by the secondary slide and the central axis.

The slide assembly includes a leading end having a connection between the main and secondary slides, and the slide assembly also has a trailing end where the adjuster extends between the main and secondary slides and provides adjustment of the positioning of the secondary slide on the main slide. The connection is a pivotal connection between the main and secondary slides at the leading end of the slide assembly, and the adjuster pivots the secondary slide with respect to the main slide about the pivotal connection at the leading end of the slide assembly.

In the preferred construction of the slide assembly, the adjuster includes a fixed thrust plate fixedly mounted on one of the slides and a movable thrust plate mounted on the other slide for movement with respect thereto. A thrust plate connector of the adjuster extends between the fixed and movable thrust plates and is pivotal with respect to the thrust plates upon movement of the moveable thrust plate with respect to the other slide to pivot the secondary slide with respect to the main slide about the pivotal axis at the leading end of the slide assembly. An actuator of the adjuster moves the movable thrust plate with respect to the other slide to thereby move the rack with respect to the central axis about which the workpiece rotates. The thrust connector of the adjuster preferably has a dog-bone construction including opposite ends respectively supported in a retained manner by the fixed and movable thrust plates. As disclosed in the preferred construction, the adjuster includes another thrust connector that extends between the fixed and movable thrust plates in a spaced relationship to the first mentioned thrust plate, and a guideway located between the thrust connectors provides guided movement of the movable thrust plate with respect to the fixed thrust plate under the operation of the actuator.

The actuator of the adjuster is preferably a servomotor that provides convenient automatic adjustment under a suitable operator control. However, it is also possible for the actuator to include a manual actuating member for use with a more economical machine which does not require the automatic adjustment by the servomotor.

Another object of the present invention is to provide an improved machine for rolling splines in a round workpiece.

In carrying out the above object, the machine of the invention includes a pair of spaced base portions that define a workspace. Headstock and tailstock supports of the machine rotatably support the workpiece within the workspace for rotation about a central axis. A pair of slide assemblies of the machine are respectively mounted by the pair of base portions for movement generally parallel to each other in opposite directions from an initial end-to-end position to an overlapping position such that a pair of elongated spline forming racks mounted by the slide assemblies roll form splines in the workpiece. Each slide assembly includes an adjuster for adjusting the spaced relationship thereof from the central axis so as to adjust the spacing between the pair of racks in order to control the extent of roll forming of the splines in the workpiece.

Each slide assembly includes a main slide that is supported for movement with respect to the central axis about which the workpiece rotates, and each slide also includes a secondary slide mounted by the main slide and defining a rack support surface that supports the rack. The adjuster of each slide assembly extends between the main and secondary slides thereof to adjust the positioning therebetween in order to adjust the spacing between the rack supported by the secondary slide and the central axis.

Each slide assembly of the machine includes a leading end having a connection between the main and secondary slides, and each slide assembly has a trailing end where the adjuster extends between the main and secondary slides and provides adjustment of the positioning of the secondary slide on the main slide. The connection of each slide assembly of the machine is a pivotal connection between the main and secondary slides at the trailing end of the slide assembly, and the adjuster pivots the secondary slide with respect to the main slide about the pivotal connection at the leading end of the slide assembly.

In the preferred construction of the machine, each slide assembly includes a fixed thrust plate fixedly mounted on one of the slides thereof and a movable thrust plate mounted on the other slide thereof for movement with respect thereto. A thrust plate connector of each slide assembly extends between the fixed and movable thrust plates and is pivotable with respect to the thrust plates upon movement of the movable thrust plate with respect to the other slide to pivot the secondary slide with respect to the main slide about the pivotal connection at the leading end of the slide assembly. An actuator of each slide assembly of the machine moves its movable thrust plate with respect to the other slide to thereby move the rack with respect to the central axis about which the workpiece rotates. The thrust plate connector of each slide assembly of the machine is preferably of a dog-bone construction that extends between the fixed and movable thrust plates and is retained thereby as well as being pivotable with respect thereto upon movement of the movable thrust plate to provide the adjustment.

The machine can be provided with the adjuster of each slide assembly embodied by a servomotor or by a manual actuating member.

The objects, features and advantages of the present invention are readily apparent from the following detailed description of the best mode for carrying out the invention when taken in connection with the accompanying drawings.

BRIEF DESCRIPTION OF DRAWINGS

FIG. 3 is an end view of one slide assembly taken along the direction of line 3—3 in FIG. 2.

FIG. 4 is a partial view of one of the slide assemblies taken at a leading end thereof along the direction of line 4—4 in FIG. 3.

BEST MODE FOR CARRYING OUT THE INVENTION

Figure 1:
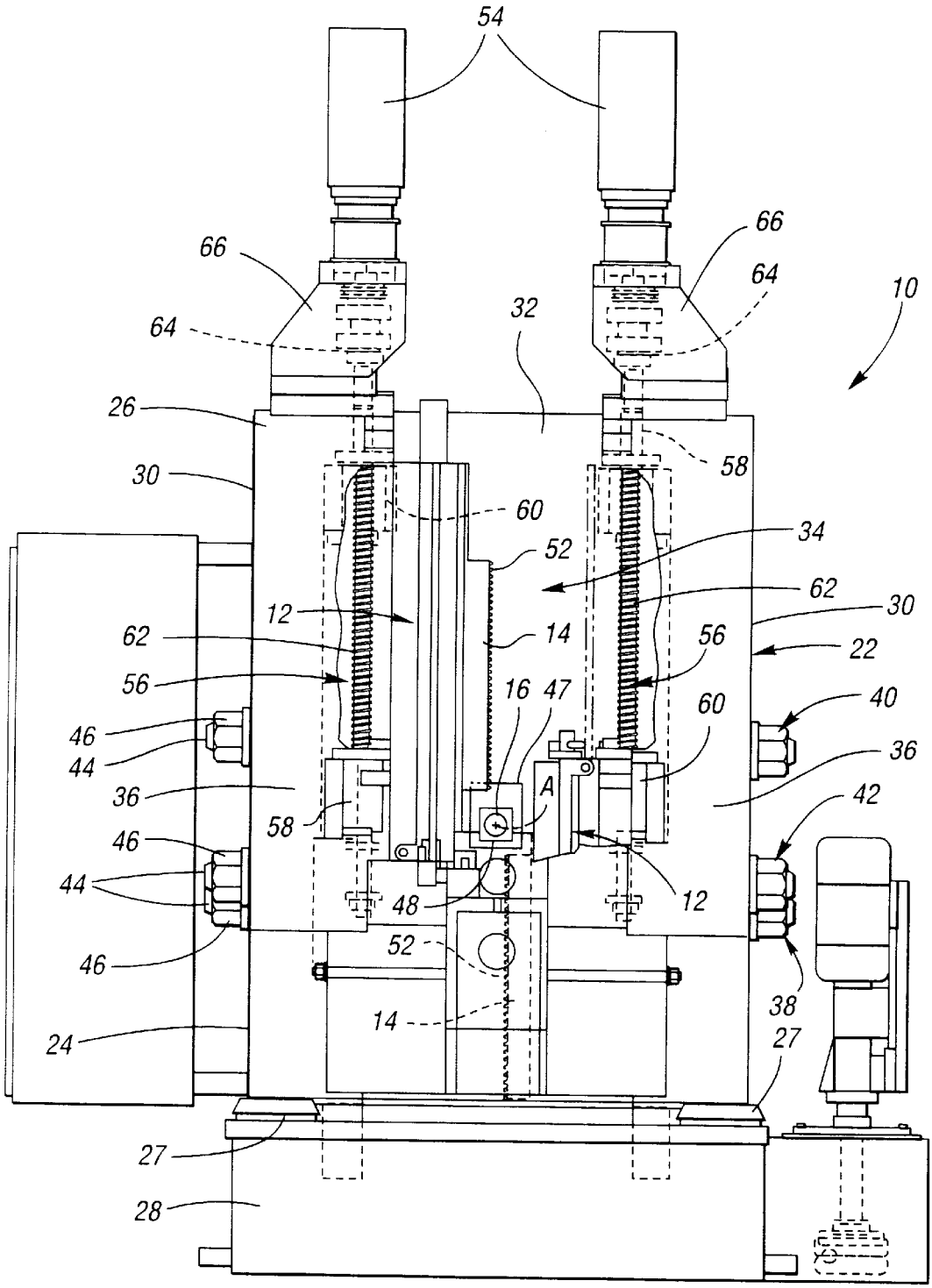
FIG. 1 is a front elevational view of a machine constructed in accordance with the invention to include a pair of slide assemblies that each support an elongated tooth forming rack for roll forming of splines.

With reference to FIG. 1 if the drawings, a spline rolling machine generally indicated by 10 is constructed in accordance with the present invention as is hereinafter more fully described and includes a pair of slide assemblies 12 that respectively support a pair of elongated toothed forming racks 14 for movement that roll forms a round workpiece 16 rotatably mounted about a central axis A. The construction of the machine 10 and the slide assemblies 12 will be given in an integrated manner so as to conveniently describe all aspects of the invention.

The splines that are rolled into the workpiece may take any form of power transmission formations such as straight or helical splines, threads, etc. as well as any other formation utilized in the rotary transmission of power from one member to another such as in a vehicle drivetrain.

The machine 10 has a construction similar to the machines disclosed by the U.S. Pat. Nos. 5,970,768, 5,983,690 and 5,987,953 of James Thomas Killop and Robert E. Roseliep, and the entire disclosure of these prior patents are hereby incorporated by reference.

Machine 10, as shown by continuing reference to FIG. 1, includes a base 22 having a lower end 24 for providing support thereof in an upwardly extending orientation. Base 22 also has an upper end 26 to which the base extends from its lower end 24 as is hereinafter more fully described. Antivibration mounts 27 mount the lower base end 24 on a lower fluid reservoir 28 for containing lubrication fluid that is pumped to the workpiece to provide lubrication and cooling thereof during the roll forming operation of the machine.

With continuing reference to FIG. 1, the base 22 includes a pair of spaced base portions 30 and also includes a rear connecting base portion 32 that is located between the spaced base portions. The spaced base portions 30 project forwardly from the connecting base portion 32 to define a vertically extending workspace 34 and have distal front ends 36 remote from the rear connecting base portion.

With combined reference to FIG. 1, tie rod assemblies 38, 40 and 42 extend horizontally between the spaced base portions 30 to provide securement thereof to the rear connecting base portion 32 and to each other. Each tie rod assembly includes a tie rod 44 having threaded ends and also includes a pair of nuts 46 threaded onto the ends of the associated tie rod. More specifically, there are two rear tie rod assemblies 38 and 40 extending between the spaced base portions 30 adjacent the rear connecting base portion 32 at lower and upper locations below and above the central axis A about which the workpiece 16 rotates during the forming operation as is hereinafter more fully described. Furthermore, the tie rod assemblies also include a front tie rod assembly 42 extending between the spaced base portions 30 adjacent the front ends 36 thereof at a location below the central axis A which facilitates the accessibility of the workpiece 16 within the workspace 34. While the base 22 includes unshown bolt connections that connect the spaced base portions 30 and the rear connecting base portion 32, the tie rod assemblies 38, 40 and 42 counteract most of the force that tends to separate the spaced base portions 30 during the roll forming process.

As illustrated in FIG. 1, the machine 10 includes a headstock spindle support 47 for mounting a headstock spindle on the rear connecting base portion 32. Furthermore, a tailstock spindle support 48 is mounted by the front ends 36 of the spaced base portions 30 and provides support of a tailstock spindle that cooperates with the headstock spindle to rotatably mount the workpiece 16 about the rotational workpiece axis A about which the forming takes place.

The pair of slide assemblies 12 are mounted for movement on the pair of spaced base portions 30 by linear antifriction bearings 49 and 50 (FIG. 5) in the manner disclosed by the aforementioned patents of Killop and Roseliep. This mounting supports the slide assemblies 12 for movement as shown in FIG. 2 between the solid line indicated end-to-end position and the partially phantom line indicated overlapping relationship, with such movement forming the splines in the workpiece 16.

Figure 2:
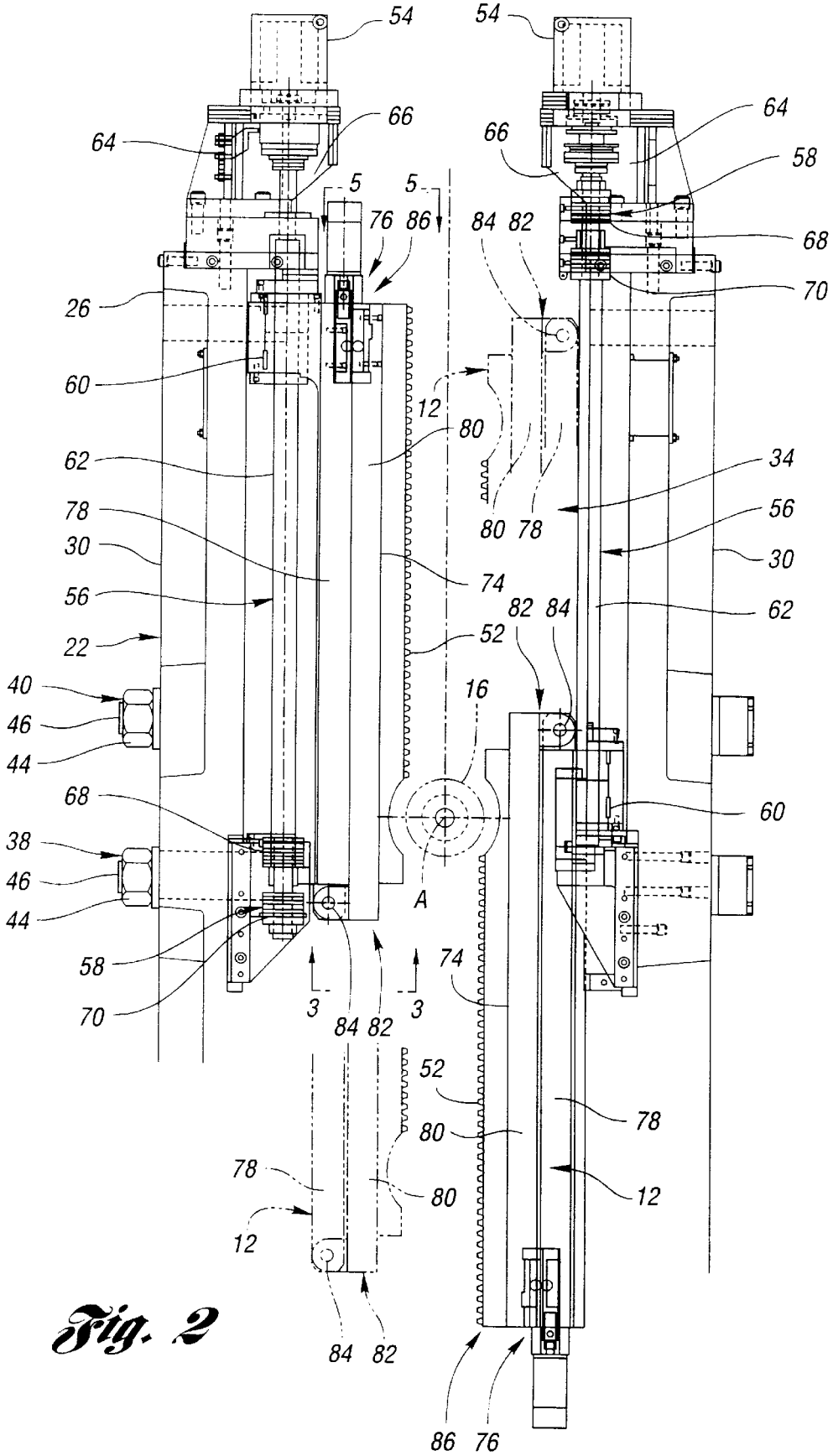
FIG. 2 is an enlarged view of portions of the machine taken in the same direction as FIG. 1 to better illustrate each of the pair of slide assemblies.

As illustrated by combined reference to FIGS. 1 and 2, the vertically actuated movement of the pair of slide assemblies 12 from the end-to-end relationship shown by solid line representation in FIG. 2 moves the forming racks 14 thereon vertically into engagement with the workpiece 16 to provide the roll forming. More specifically, the left slide assembly 12 and the forming rack 14 thereon are moved downwardly while the right slide assembly 12 and the forming rack 14 thereon are moved upwardly such that toothed forming faces 52 thereon engage the workpiece 16 at diametrically opposite locations to provide the forming of the splines by plastic deformation. Such forming is normally in a progressive manner such that the workpice will execute a number of rotations before the forming is completed.

With continuing reference to FIGS. 1 and 2, the machine 10 also includes a pair of electric servomotors 54 for respectively moving the pair of slide assemblies 12 and the forming racks 14 thereon to roll the splines in the workpiece 16 as previously described. A pair of slide rotary connectors 56 respectively extend between the pair of servomotors 54 and the pair of slide assemblies 12 on which the forming racks 14 are mounted. Each rotary connector 56 includes a rotary coupling 58 to the machine base 22 and also includes a rotary coupling 60 to the associated slide assembly 12. An elongated rotary connection member 62 of each rotary connector 56 extends vertically and is rotatively driven by the associated electric servomotor 54 through a gear reducer 64. Each rotary connection member 62 is rotatively driven by the associated electric servomotor 54 through the associated gear reducer 64 and is axially fixed by the associated rotary coupling 58 to the base as well as being threadedly connected to the associated rotary coupling 60 to the associated slide assembly 12 such that the driving rotation thereof provides movement of the slide assembly under the impetus of the electric servomotor.

As illustrated both in FIGS. 1 and 2, the machine base 22 includes mounts 66 that respectively support the pair of electric servomotors 54 in a side-by-side relationship. As shown, the electric servomotors 54 extend upwardly; however, it should be appreciated that it is also possible for mounts 66 to support the electric servomotors 54 extending horizontally when there is a height limitation. One of the rotary connectors 56, specifically the right one as shown, has the rotary coupling 58 thereof to the base 22 located adjacent the associated electric servomotor 54 adjacent the upper base end 26. The associated elongated rotary connection member 62 extends from this upper coupling 58 downwardly to the rotary coupling 60 thereof to the associated slide assembly 12 to pull the slide assembly upwardly past the central axis A during rolling of the splines in the workpiece as previously described. The other rotary connector 56, specifically the left one as shown, has the rotary coupling 58 thereof to the base 22 located adjacent the central axis A and the elongated rotary connection member 62 thereof extends upwardly therefrom to the rotary coupling 60 thereof to the associated slide assembly 12 and to the associated electric servomotor 54 to pull the slide assembly downwardly past the central axis A during the rolling of the splines.

Each of the rotary couplings 58 to the base 22 has the construction illustrated in FIG. 2 and specifically includes a pair of axial thrust bearings 68 and 70. Each rotary connection member 62 is thus axially fixed with respect to the base by the associated pair of thrust bearings 68 and 70. These thrust bearings are located adjacent the upper servomotor 54 at the right side and are located at the adjacent the central axis A at the left side. Conversely, the rotary coupling 60 to the base is located adjacent the central axis A at the right side and is located adjacent the upper servomotor 54 at the left side. Rotary driving the servomotors 54 through gear reducers 64 rotates the rotary connection members 62 and through the rotary couplings 60 to the slide assemblies 12 provides the movement of the slide assemblies between the end-to-end relationship and the overlapping relationship as previously described.

As best illustrated in FIG. 2, each slide assembly 12 includes a rack support surface 74 for supporting the associated rack 14 in a spaced relationship with respect to the central axis A about which the workpiece 16 rotates during the forming. An adjuster 76 of each slide assembly 12 adjusts the spacing between the support surface 74 of the slide assembly and the central axis A to control the extent of roll forming splines in the workpiece 16.

With continuing reference to FIG. 2, each slide assembly 12 includes a main slide 78 that is supported on the associated machine base by the previously described linear antifriction bearings for movement with respect to the central axis about which the workpiece 16 rotates. Each slide assembly 12 also includes a secondary slide 80 mounted by the main slide 78 and defining the rack support surface 74 that supports the associated rack 14. The adjuster 76 of each slide assembly extends between the main slide 78 and the secondary slide 80 to adjust the positioning therebetween in order to adjust the spacing between the rack 14 supported by the secondary slide and the central axis A.

Figure 5:
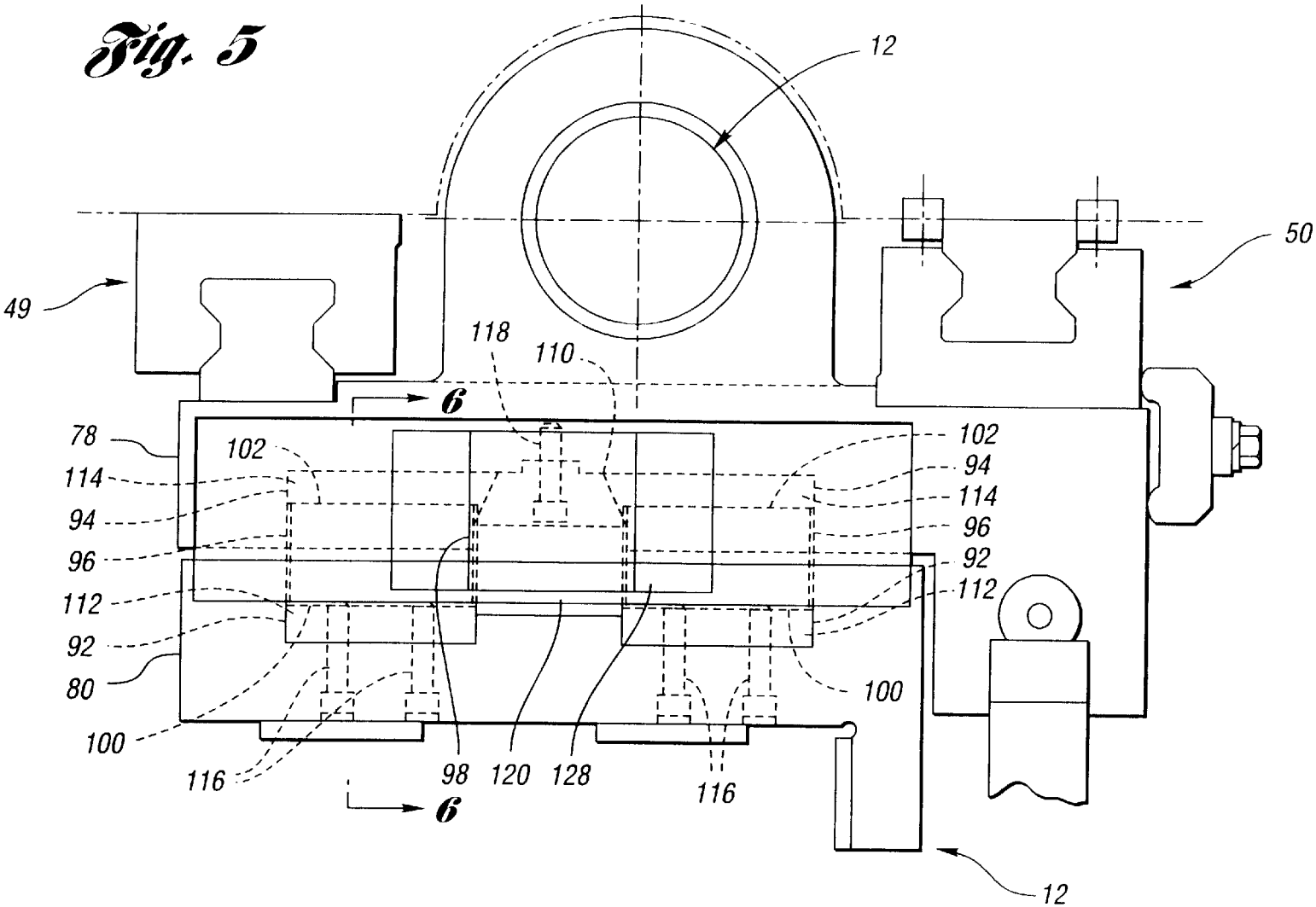
FIG. 5 is an end view of one of the slide assemblies taken along the direction of line 5—5 in FIG. 2 at a trailing end of the slide assembly.

As shown best in FIGS. 3 and 4, each slide assembly 12 includes a leading end 82 having a connection 84 between the main and secondary slides 78 and 80. Each slide assembly 12 as shown in FIGS. 5–7 has a trailing end 86 where the adjuster 76 extends between the main and secondary slides 78 and 80 and provides adjustment of the positioning of the secondary slide on the main slide.

The connection 84 shown in FIGS. 3 and 4 is a pivotal connection between the main and secondary slides 78 and 80 at the leading end 82 of the slide assembly. This pivotal connection 84 includes a pin 88 that extends in opposite directions from a pivotal support 90 on the main slide 78 into pivotal supports 92 on the secondary slide 80 so as to support the secondary slide for pivoting about a pivot axis B as shown in FIG. 4. The adjuster 76 at the trailing end 86 of the slide assembly moves the secondary slide 80 with respect to the main slide 78 about the pivotal connection at the leading end of the slide assembly so as to provide the adjustment between the tooth forming face of the associated rack 14 and the workpiece. It should be noted that the maximum amount of adjustment involved is only about 20 thousandths of an inch (about 0.045 cm) or so and is at the trailing end where the final forming takes place such that any angularity involved with the pivoting is inconsequential in determining the final workpiece spline profile.

Figure 6:
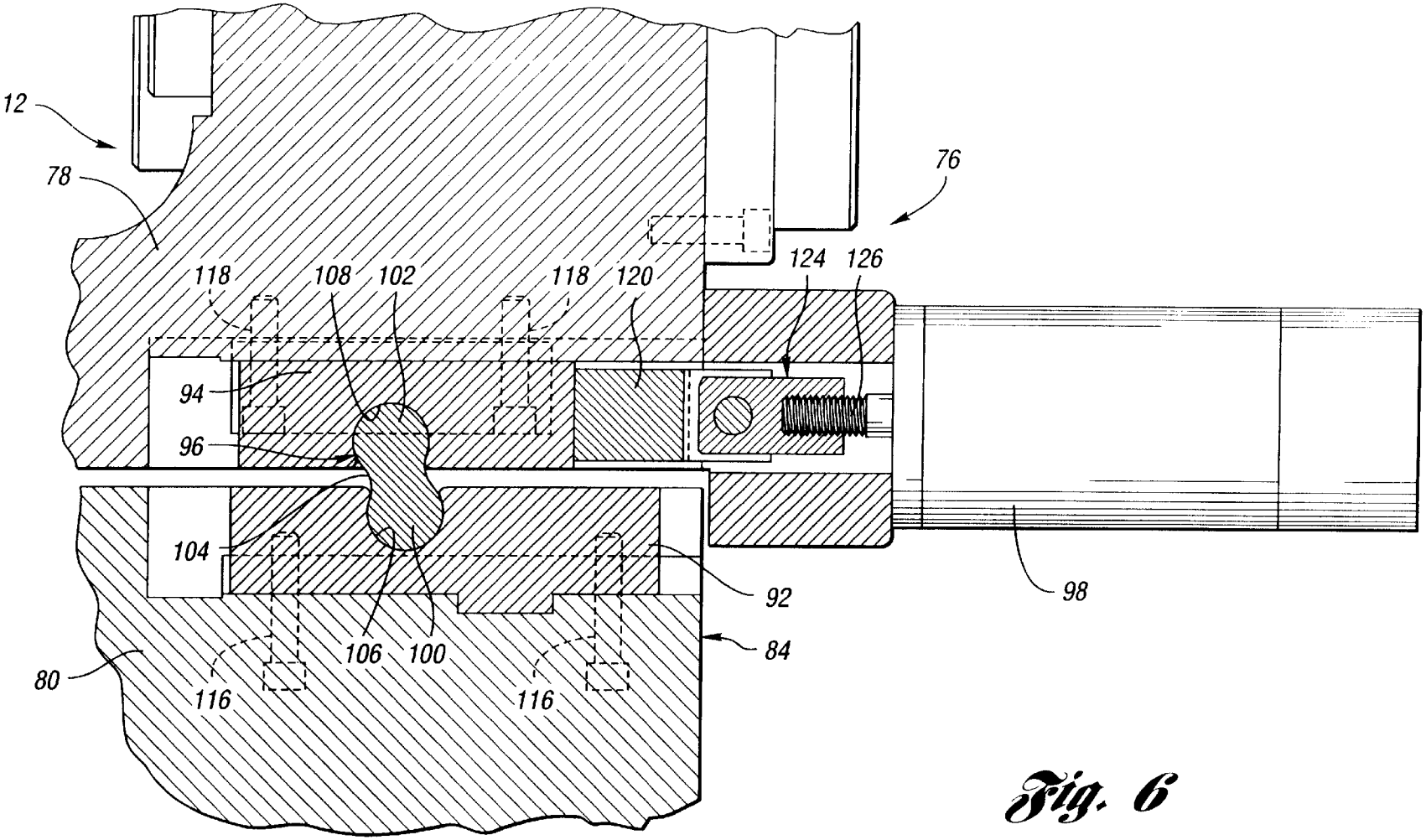
FIG. 6 is a sectional view taken along the direction of line 6—6 in FIG. 5 to illustrate the construction of an adjuster that adjusts the position at which the slide assembly positions an associated tooth forming rack with respect to the workpiece and is illustrated at an intermediate position between a minimum and maximum spacing.
Figure 7:
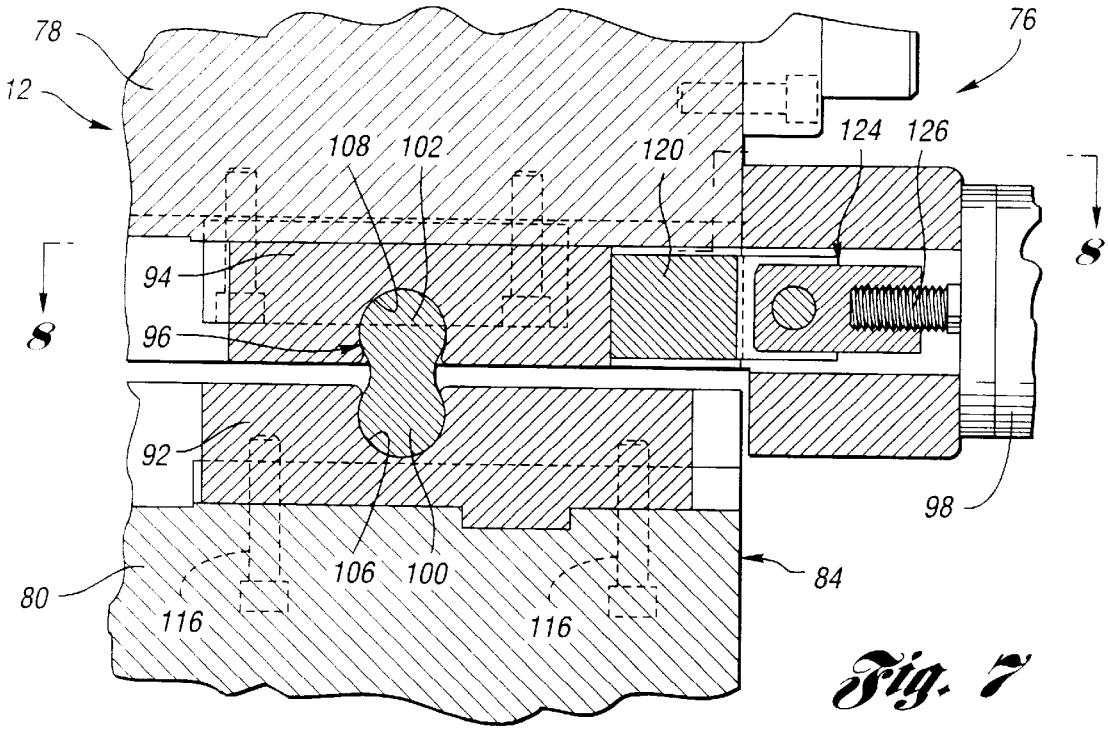
FIG. 7 is a partial view similar to FIG. 6 showing the adjuster positioning the slide assembly at a minimum spacing with respect to the workpiece.

As shown in FIGS. 6 and 7, the adjuster 76 includes a fixed thrust plate 92 fixedly mounted on one of the slides which is the secondary slide 80 as illustrated. A movable thrust plate 94 of the adjuster is mounted on the other slide for movement with respect thereto, which other slide is the main slide 78 as illustrated. A thrust plate connector 96 extends between the fixed and movable thrust plates 92 and 94 and is pivotable with respect to the thrust plates upon movement of the movable thrust plate with respect to the main slide 78 and thereby pivots the secondary slide 80 with respect to the main slide about the pivotal connection 84 at the leading end 82 of the slide assembly as shown in FIG. 2. An actuator 98 best shown in FIG. 6 moves the movable thrust plate 94 with respect to the main slide 78 to thereby more the rack 14 supported thereby with respect to the central axis A about which the workpiece 16 rotates. The minimum spacing between the forming face 52 of the rack 14 is when the thrust connector 96 extends generally perpendicular to the fixed and movable thrust plates 92 and 94 as shown in FIG. 7. Movement under control of the actuator 98 of the movable thrust plate positions the thrust connector 96 angularly as shown in FIG. 6 to increase the spacing between the toothed forming face of each rack 14 and the central axis A.

As shown in FIGS. 6 and 7, the thrust plate connector 96 has a dog-bone construction including enlarged opposite ends 100 and 102 of round shapes that are connected by a curved intermediate portion 104 and respectively received within generally round grooves 106 and 108 in the fixed and movable thrust plates 92 and 94 so as to be retained thereby and thus limit movement of the secondary slide 80 away from the main slide 78.

With reference to FIG. 5, the adjuster 76 preferably includes a pair of the thrust connectors 96 that extend between the fixed and movable thrust plates 92 and 94 in a spaced relationship from each other. A guideway 110 is mounted on the main slide 78 between the pair of thrust connectors 96. Both the fixed and movable thrust plates 92 and 94 have a pair of spaced portions 112 and 114 between which the pair of thrust connectors 96 extend. Bolts 116 secure the fixed thrust plate portions 112 to the secondary slide 80, while the guideway 110 retains the movable thrust plate portions 114 on the main slide 78 by an angular construction thereof and securement bolts 118.

Figure 8:
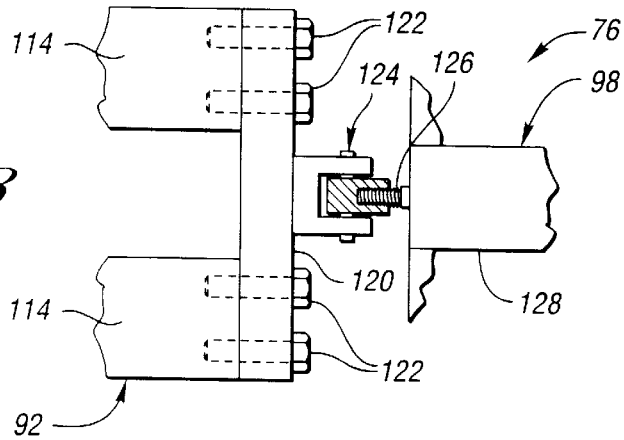
FIG. 8 is a plan view taken along the direction of line 8—8 in FIG. 7 to illustrate a yoke connection of a servomotor actuator to a pair of thrust plates of the adjuster.

As shown in FIG. 8, the movable thrust plate portions 114 of the movable thrust plate 94 are secured to each other by a yoke 120 and bolts 122. A clevis connection 124 connects the movable thrust plate yoke 120 and an output 126 of the actuator 98 which as illustrated is a servomotor 128 for moving the movable thrust plate portions and thereby adjusting the rack spacing with respect to the central axis as previously described.

Figure 9:
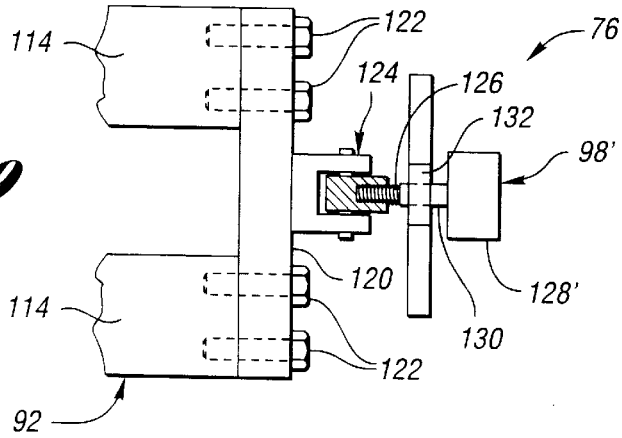
FIG. 9 is a view similar to FIG. 8 but illustrating the adjuster as including a manual actuating member.

With reference to FIG. 9, another embodiment illustrates the actuator 98' as including a manual actuating member 128' connected to a threaded member 130 that extends through a threaded hole member 132 for connection by the clevis connection 124 to the movable thrust member yoke 120. Such a manual version of the actuator is more economical and can be utilized when automatic adjustment is not necessary.

While the best mode for carrying out the invention has been described in detail, those familiar with the art to which this invention relates will recognize various alternative designs and embodiments for practicing the present invention as defined by the following claims.

What is claimed is:

1. A slide assembly for supporting an elongated toothed forming rack for movement that roll forms splines in a round workpiece rotatably mounted about a central axis, the slide assembly comprising;

the slide assembly having leading and trailing ends and an intermediate portion extending therebetween;

a main slide that is supported for movement with respect to the central axis about which the workpiece rotates;

a secondary slide mounted on the main slide and including a rack support surface for supporting the rack in a spaced relationship with respect to the central axis;

a pivotal connection that extends between the main and secondary slides at the leading end of the slide assembly to pivotally support the secondary slide on the main slide;

an adjuster extending between the main slide and the secondary slide at the trailing end of the slide assembly to pivotally adjust the positioning of the secondary slide on the main slide in order to adjust the spacing between the rack supported by the secondary slide and the central axis to control the extent of roll forming splines in the workpiece.

2. A toothed forming rack slide assembly as in claim 1 wherein the adjuster includes a fixed thrust plate fixedly mounted on one of the slides, a movable thrust plate mounted on the other slide for movement with respect thereto, a thrust plate connector that extends between the fixed and movable thrust plates and is pivotable with respect to the thrust plates upon movement of the movable thrust plate with respect to the other slide to pivot the secondary slide with respect to the main slide about the pivotal connection at the leading end of the slide assembly, and an actuator that moves the movable thrust plate with respect to the other slide to thereby move the rack with respect to the central axis about which the workpiece rotates.

3. A toothed forming rack slide assembly as in claim 2 wherein the thrust connector of the adjuster has a dog-bone construction including opposite ends respectively supported in a retained manner by the fixed and movable thrust plates.

4. A toothed forming rack slide assembly as in claim 2 wherein the adjuster includes another thrust connector that extends between the fixed and movable thrust plates in a spaced relationship to the first mentioned thrust connector, and a guideway located between the thrust connectors and providing guided movement of the movable thrust plate with respect to the fixed thrust plate under the operation of the actuator.

5. A toothed forming rack slide assembly as in claim 2 wherein the actuator comprises a servomotor.

6. A toothed forming rack slide assembly as in claim 2 wherein the actuator includes a manual actuating member.

7. A slide assembly for supporting an elongated toothed forming rack for movement that roll forms splines in a round workpiece rotatably mounted about a central axis, the slide assembly comprising;

the slide assembly having leading and trailing ends and an intermediate portion extending therebetween;

a main slide that is supported for movement with respect to the central axis about which the workpiece rotates;

a secondary slide mounted on the main slide and including a rack support surface for supporting the rack in a spaced relationship with respect to the central axis;

a pivotal connection that extends between the main and secondary slides at the leading end of the slide assembly to pivotally support the secondary slide on the main slide;

an adjuster extending between the main slide and the secondary slide at the trailing end of the slide assembly to pivotally adjust the positioning of the secondary slide on the main slide in order to adjust the spacing between the rack supported by the secondary slide and the central axis to control the extent of roll forming splines in the workpiece, the adjuster including a fixed thrust plate fixedly mounted on one of the slides, a movable thrust plate mounted on the other slide for movement with respect thereto, a thrust plate connector that extends between the fixed and movable thrust plates and is pivotable with respect to the thrust plates upon movement of the movable thrust plate with respect to the other slide to pivot the secondary slide with respect to the main slide about the pivotal connection at the leading end of the slide assembly, and an actuator that moves the movable thrust plate with respect to the other slide to thereby move the rack with respect to the central axis about which the workpiece rotates.

8. A machine for rolling splines in a round workpiece, comprising:

a pair of spaced base portions that define a workspace;

headstock and tailstock supports for rotatably supporting the workpiece within the workpiece for rotation about a central axis;

a pair of slide assemblies respectively mounted by the pair of base portions for movement generally parallel to each other in opposite directions from an initial end-to-end position to an overlapping position such that a pair of elongated spline forming racks mounted by the slide assemblies roll form splines in the workpiece; and each slide assembly including an adjuster for adjusting the spaced relationship thereof from the central axis so as to adjust the spacing between the pair of racks in order to control the extent of roll forming of the splines in the workpiece.

9. A machine for rolling splines in a round workpiece, comprising:

a pair of spaced base portions that define a workspace;

headstock and tailstock supports for rotatably supporting the workpiece within the workpiece for rotation about a central axis;

a pair of slide assemblies respectively mounted by the pair of base portions for movement generally parallel to each other in opposite directions from an initial end-to-end position to an overlapping position such that a pair of elongated spline forming racks mounted by the slide assemblies roll form splines in the workpiece;

each slide assembly having leading and trailing ends and including a main slide that is supported on one of the base portions for movement with respect to the central axis;

each slide assembly having a secondary slide mounted on the main slide and including a rack support surface for supporting one of the racks;

each slide assembly including a pivotal connection that extends between the main and secondary slides thereof at the leading end of the slide assembly to pivotally support the secondary slide on the main slide; and each slide assembly including an adjuster extending between the main slide and the secondary slide thereof at the trailing end of the slide assembly to pivotally adjust the positioning of the secondary slide on the main slide in order to adjust the spacing between the rack supported by the secondary slide and the central axis to control the extent of roll forming splines in the workpiece.

10. A spline rolling machine as in claim 9 wherein the adjuster of each slide assembly includes a fixed thrust plate fixedly mounted on one of the slides thereof, a movable thrust plate mounted on the other slide thereof for movement with respect thereto, a thrust plate connector that extends between the fixed and movable thrust plates and is pivotable with respect to the thrust plates upon movement of the movable thrust plate with respect to the other slide to pivot the secondary slide with respect to the main slide about the pivotal connection at the leading end of the slide assembly, and an actuator that moves the movable thrust plate with respect to the other slide to thereby move the spline forming rack with respect to the central axis about which the workpiece rotates.

11. A spline rolling machine as in claim 9 wherein the adjuster of each slide assembly includes a fixed thrust plate fixedly mounted on one of the slides thereof, a movable thrust plate mounted on the other slide thereof for movement with respect thereto, a thrust plate connector of a dog-bone construction that extends between the fixed and movable thrust plates and is retained thereby as well as being pivotable with respect to the thrust plates upon movement of the movable thrust plate with respect to the other slide to pivot the secondary slide with respect to the main slide about the pivotal connection at the leading end of the slide assembly, and an actuator that moves the movable thrust plate with respect to the other slide to thereby move the spline forming rack with respect to the central axis about which the workpiece rotates.

12. A spline rolling machine as in claim 10 wherein the adjuster of each slide assembly is a servomotor.

13. A spline rolling machine as in claim 10 wherein the adjuster of each slide assembly includes a manual actuating member.

14. A machine for rolling splines in a round workpiece, comprising:

a pair of spaced base portions that define a workspace;

headstock and tailstock supports for rotatably supporting the workpiece within the workspace for rotation about a central axis;

a pair of slide assemblies respectively mounted by the pair of base portions for movement generally parallel to each other in opposite directions from an initial end-to-end position to an overlapping position such that a pair of elongated spline forming racks mounted by the slide assemblies roll form splines in the workpiece;

each slide assembly having leading and trailing ends and including a main slide that is supported on one of the base portions for movement with respect to the central axis;

each slide assembly having a secondary slide mounted on the main slide and including a rack support surface for supporting one of the racks;

each slide assembly including a pivotal connection that extends between the main and secondary slides thereof at the leading end of the slide assembly to pivotally support the secondary slide on the main slide;

each slide assembly including an adjuster extending between the main slide and the secondary slide thereof at the trailing end of the slide assembly to pivotally adjust the positioning of the secondary slide on the main slide in order to adjust the spacing between the rack supported by the secondary slide and the central axis to control the extent of roll forming splines in the workpiece; and the adjuster of each slide assembly including a fixed thrust plate fixedly mounted on one of the slides thereof, a movable thrust plate mounted on the other slide thereof for movement with respect thereto, a thrust plate connector that extends between the fixed and movable thrust plates and is pivotable with respect to the thrust plates upon movement of the movable thrust plate with respect to the other slide to pivot the secondary slide with respect to the main slide about the pivotal connection at the leading end of the slide assembly, and an actuator that moves the movable thrust plate with respect to the other slide to thereby move the rack with respect to the central axis about which the workpiece rotates.

* * * * *